US006976495B2

(12) United States Patent
Vena et al.

(10) Patent No.: US 6,976,495 B2
(45) Date of Patent: Dec. 20, 2005

(54) COSMETIC APPLICATOR AND STORAGE CONTAINER

(75) Inventors: Lou Ann Christine Vena, Scotch Plains, NJ (US); Saroja Narasimhan, Matawan, NJ (US); Maxine Gayle Moore, Piscataway, NJ (US); Glenn Robert Geardino, Edison, NJ (US); Manharbhai Kantibhai Patel, Saddlebrook, NJ (US)

(73) Assignee: Revlon Consumer Products Corporation, New York, NY (US)

( * ) Notice: Subject to any disclaimer, the term of this patent is extended or adjusted under 35 U.S.C. 154(b) by 261 days.

(21) Appl. No.: 10/271,085

(22) Filed: Oct. 15, 2002

(65) Prior Publication Data

US 2004/0011370 A1 Jan. 22, 2004

Related U.S. Application Data

(60) Provisional application No. 60/397,472, filed on Jul. 19, 2002.

(51) Int. Cl.[7] ..... A45D 24/22
(52) U.S. Cl. ..... 132/112; 132/116
(58) Field of Search ..... 132/112–116, 111; 222/94, 129

(56) References Cited

U.S. PATENT DOCUMENTS

| | | | | |
|---|---|---|---|---|
| 1,635,176 A | | 7/1927 | Dorment | |
| 2,897,826 A | | 8/1959 | Di Vito | 132/114 |
| 3,059,652 A | | 10/1962 | Thomas | 132/112 |
| 3,456,658 A | | 7/1969 | Long, Jr. | 132/116 |
| 4,813,439 A | | 3/1989 | Morgan | 132/116 |
| 5,215,106 A | * | 6/1993 | Choi | 132/109 |
| 5,738,121 A | | 4/1998 | Westerveld | 132/113 |
| 5,909,737 A | * | 6/1999 | Ricco | 132/116 |
| 6,112,751 A | * | 9/2000 | Bennett | 132/116 |
| 6,286,518 B1 | * | 9/2001 | Laporte | 132/116 |
| 6,440,177 B1 | * | 8/2002 | Orr | 8/426 |
| 6,453,909 B1 | | 9/2002 | De Laforcade | 132/208 |
| 6,457,476 B1 | | 10/2002 | Elmer et al. | 132/113 |
| 6,688,314 B1 | * | 2/2004 | Hoeffkes et al. | 132/114 |

FOREIGN PATENT DOCUMENTS

| | | |
|---|---|---|
| DE | 3931111 | 3/1991 |
| JP | 411018822 A | 1/1999 |
| JP | 11137329 A | 5/1999 |
| JP | 02001046140 A | 2/2001 |

* cited by examiner

*Primary Examiner*—John J. Wilson
*Assistant Examiner*—Robyn Doan
(74) *Attorney, Agent, or Firm*—Julie Blackburn

(57) ABSTRACT

A cosmetic container and packaged hair treatment composition comprising a receptacle having at least one opening and containing the hair treatment composition, an applicator for applying the hair treatment composition in the receptacle to the hair, which is attachable to the at least one opening of the receptacle, the applicator containing an internal channel feeding into at least one internal chambers having at least one external outlet surrounded by tines, a method for applying highlights to the hair using the package.

17 Claims, 6 Drawing Sheets

COSMETIC APPLICATOR AND STORAGE CONTAINER

This application claims priority from provisional patent application Ser. No. 60/397,472, filed Jul. 19, 2002.

TECHNICAL FIELD

The invention is in the field of containers for cosmetic products and particularly cosmetic containers and applicators, which are used to apply cosmetic materials such as conditioner, hair dye, bleach, and highlights to the hair.

BACKGROUND OF THE INVENTION

There are a variety of cosmetic applicators that are currently used to apply cosmetic ingredients to hair but there are many deficiencies in such applicators. For example, when it comes to highlighting the hair, there have been no improvements in the age old methods. If the process is done in the salon, the beauty operator simply selects the strands of hair desired for treatment and spreads them on small pieces of metal foil throughout the hair. This process relies on the judgment and skill of the beautician, and is time consuming.

The at-home highlighting kits contain a plastic cap similar to a bathing cap, having perforations throughout. The individual puts the cap on her head then extracts strands of hair through the perforations in the cap by pulling them through with a device similar to a crochet hook. This is also time consuming and laborious.

There are a variety of devices such as combs and other types of applicators that enable application of highlights to hair, but they are mostly used as an aid by the beautician, who must still exercise skill and judgment as to the pattern of highlights.

Accordingly, there is a need for a cosmetic container and applicator that facilitates application of color to hair, more particularly applying highlights to hair.

It is an object of the invention to provide a cosmetic applicator and storage container that is very consumer friendly and can be used to apply highlights to hair.

It is a further object of the invention to provide a cosmetic applicator and storage container that enables application of salon quality highlights to hair by individuals who are not trained beauticians.

It is a further object of the invention to provide a cosmetic applicator and storage container that is inexpensive to make and applies an even distribution of the highlighting composition to the hair that is treated.

It is a further object of the invention to provide a cosmetic applicator and storage container that can simply be stroked through the hair in the manner of a comb and will provide even and effective distribution of the highlighting composition.

SUMMARY OF THE INVENTION

The invention is directed to a packaged hair treatment composition comprising:

(a) a receptacle having at least one opening and containing the hair treatment composition, (b) an applicator for applying the hair treatment composition in the receptacle to the hair, which is attachable to the at least one opening of the receptacle, said applicator containing an internal channel feeding into at least one internal chamber having at least one external outlet surrounded by tines.

The invention is further directed to a method for applying highlights to hair with a composition comprised of a mixture of persulfate salts and an aqueous based oxidizing agent comprising:

(a) storing the persulfate salts in a container comprised of a receptacle having at least one opening.

(b) adding the aqueous based oxidizing agent to the receptacle, (c) affixing to the receptacle an applicator which has an internal channel which feeds into at least one internal chamber having at least one external outlet surrounded by tines, (d) distributing the hair color composition onto select strands of hair by combing the tines through the hair while the hair color composition flows out of the receptacle and through the applicator onto the hair.

The invention is further directed to a cosmetic container comprising:

(a) a receptacle for containing a cosmetic product having at least one opening, (b) an applicator for application of the cosmetic contained in the receptacle and attachable to the at least one opening of the receptacle, said applicator containing a channel for permitting flow of the cosmetic from the receptacle through the applicator, said channel feeding into at least one internal chamber having at least one outlet surrounded by tines operable to distribute the cosmetic in the receptacle onto the desired surface upon contact therewith.

DETAILED DESCRIPTION

Figure 2:
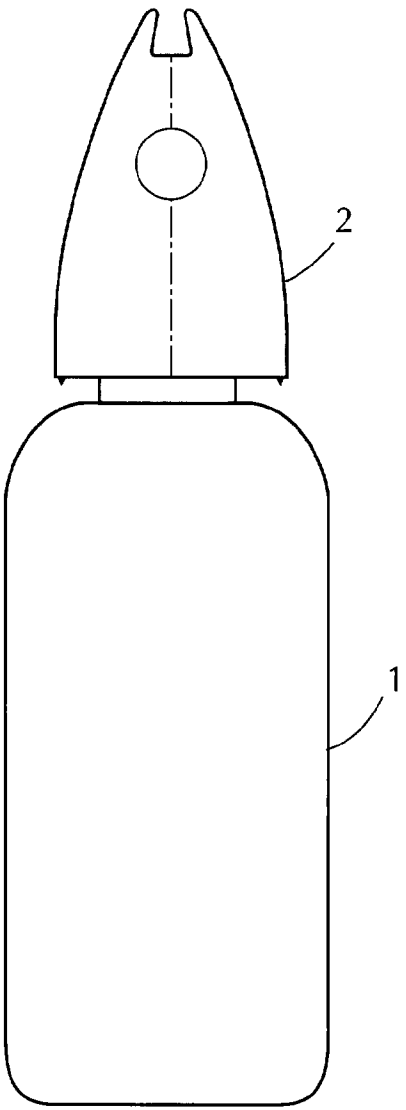
FIG. 2: is a side view of the cosmetic container of the invention.
Figure 1:
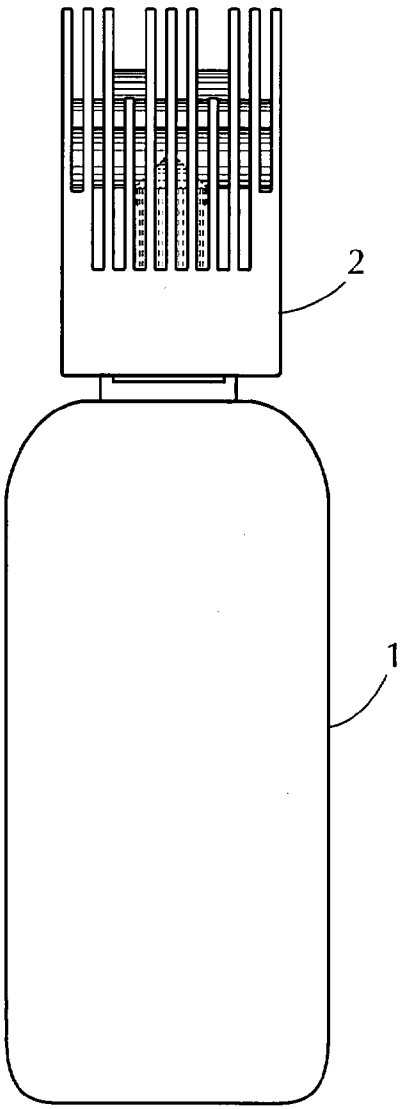
FIG. 1: is a front view of the cosmetic container of the invention comprising a receptacle and an applicator.
Figure 4:
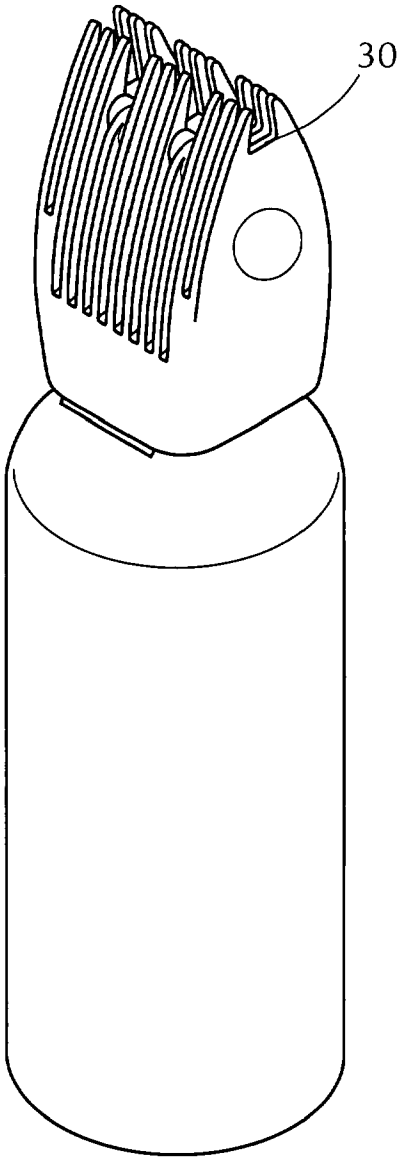
FIG. 4: is a front perspective view of the cosmetic container of the invention.

FIG. 1 depicts the cosmetic container of the invention which comprises a receptacle 1 and applicator 2. The receptacle 1 may be made from a variety of materials including glass, plastic, etc. but plastic is generally preferred because it is inexpensive and will not break. The types of plastics, or thermoplastic materials, may vary depending on the type of cosmetic to be contained within the receptacle. Generally suitable are polyethylene, polypropylene, ABS, styrene, and so on. The receptacle has at least one opening 1A.

Figure 5:
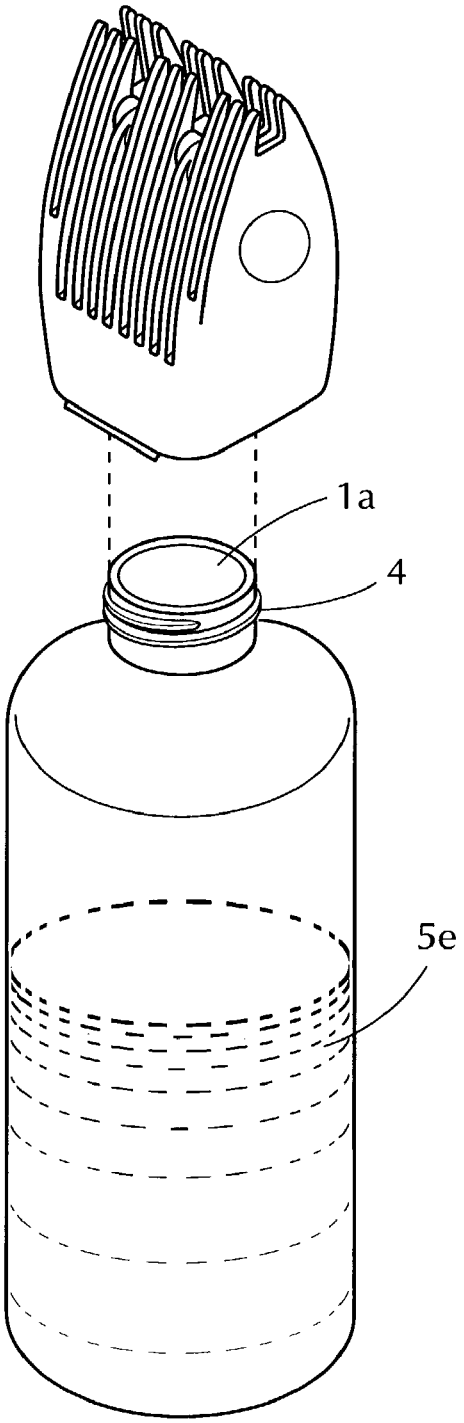
FIG. 5: is an exploded view of the cosmetic container of the invention.
Figure 6:
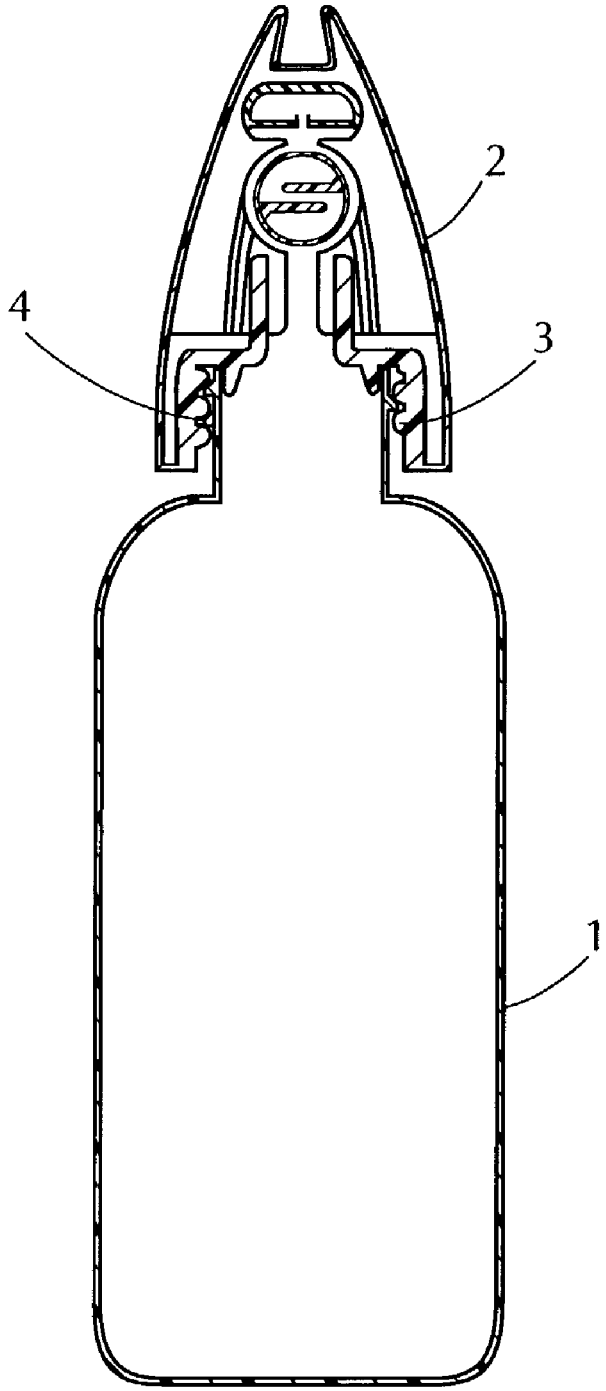
FIG. 6: is a side cutaway view of the cosmetic container of the invention.
Figure 7A:
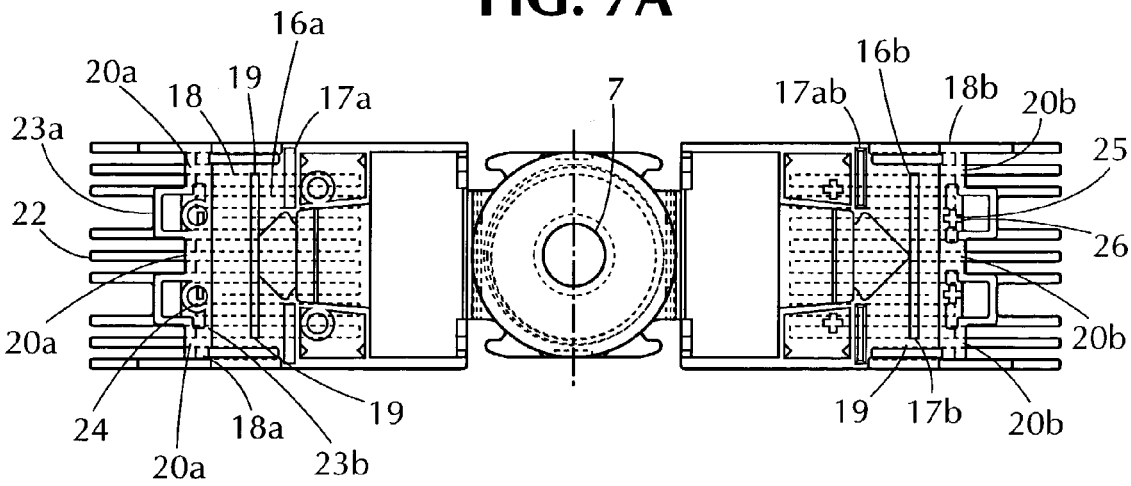
FIG. 7A: is a top plan view of the applicator in the open position.
Figure 7B:
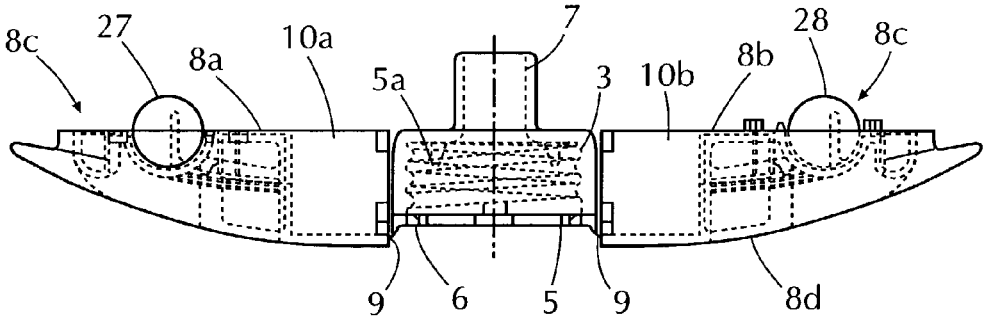
FIG. 7B: is a side plan view of the applicator in the open position.
Figure 7C:
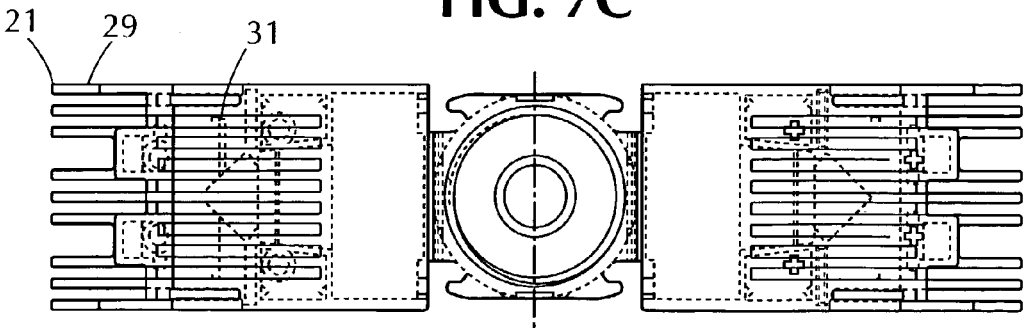
FIG. 7C: is a bottom plan view of the applicator in the open position.

The applicator 2 is removable from the receptacle 1 (see FIG. 5), and contains engaging means 3 (see FIG. 6) that are designed to mate with engaging means 4 on the receptacle 1 to permit the applicator 2 to be affixed securely to the receptacle so that the cosmetic material 5E found within the receptacle 1 flows through the one opening 1A into and through the applicator 2 such that the cosmetic material 5E will be dispensed onto the hair. The engaging means 4 on the receptacle 1 and the engaging means 3 on the applicator are most preferably screw threads. When the applicator 2 is engaged to the receptacle and used to apply cosmetic material 5E to the hair as depicted in FIG. 7F, the cosmetic material 5E found within the receptacle 1 flows through the at least one opening 1A, through the interior of the applicator 2, and out the outlets 20 (see FIG. 3). The cosmetic material 5E that flows out of outlets 20 is deposited onto the hair using tines 21. Tines 21 extend beyond outlets 20.

Because successful highlighting of hair using the cosmetic container of the invention requires that both the amount and distribution of the highlighting composition be correct, the interior of the applicator has certain configurations that optimize the flow and dose of the cosmetic material 5E found within the receptacle 1 when the applicator 2 is used to apply the cosmetic material 5E to the hair. To facilitate molding, the applicator is molded in one flat piece as depicted in FIGS. 7A, B, and C. The flat piece in general comprises a base 5 and two side walls 8A and 8B which fold up and engage about the base portion to form the applicator as depicted in FIG. 7E. The interior portions of the sidewalls 8A and 8B, when engaged, provide at least one, preferably a plurality of channels which channel the amount and flow of the cosmetic material 5E through the interior of the applicator in the most optimal manner to achieve the end result of a natural, yet polished, salon quality highlights.

The interior of the applicator is best illustrated in FIGS. 7A, B, C, and D which illustrate the applicator when it is in the open position. The applicator comprises a base 5 and two side walls 8A and 8B. Generally the base 5 is in the form of a cap for the receptacle 1 but which has an opening in the form of a channel 7 to permit the cosmetic material in the receptacle 1 to pass therethrough.

More particularly, the base 5 has an inner surface 5A and an outer surface 5B. The inner surface 5A of the bottom portion 6 of the base 5 has engaging means 3 that permit the bottom portion 6 of the base 5 to be affixed securely to the engaging means 4 on the receptacle 1. The outer surface 5B of the base 5 forms a circumferential wall 5C and a shoulder 5D. The base 5 has a top portion 7A containing a channel 7 that permits flow of the cosmetic material 5E found within the receptacle 1 from the receptacle 1 into the interior of the applicator 2. The channel 7 has circumferential side walls 17AA forming the external surface thereof Attached to the base 5 bottom portion 6 are two side walls 8A and 8B which are preferably attached to the base by living hinges 9. Sidewalls 8A and 8B have an internal surface 8C which forms the interior portion of the applicator 2, and an external surface 8D which forms the exterior surface of applicator 2.

The internal surface 8C of side walls 8A and 8B each have a carved out portion 10A and 10B on side walls 8A and 8B respectively, formed by circumferential outer walls 11A and 11B respectively. When side walls 8A and 8B are engaged, the carved out portions 10A and 10B form a compartment that houses the base 5. Each of circumferential outer walls 11A and 11B have a perimeter such that when the applicator 2 is closed by joining side walls 8A and 8B, circumferential outer walls 11A and 11B join to form one complete wall to completely surround circumferential wall 5C that is found on the outer surface 5B of the base 5 when the side walls 8A and 8B are in the closed position.

Circumferential walls 11A and 11B have a shoulder 12A and 12B respectively, and a collar 13A in side wall 8A and collar 13B in side wall 8B. Collars 13A and 13B are in the shape of half circles which have an inner surfaces 14A and 14B on each sidewall 8A and 8B such that inner surfaces 14A and 14B, when joined by closing of the applicator, together form a complete circular collar that fits snugly around the outer surface 17AA of the channel 7 when the applicator 2 is in the closed position. Each collar 13A and 13B has two side walls 15A and 15B respectively that have a flat surface such that when the applicator 2 is in the closed position, the side walls 15A mate with corresponding side walls 15B when the applicator 2 is closed. At the top edge of sidewalls 15A and 15B are engaging means. On side wall 15A the engaging means is a depression 15C and on the other side is a protrusion 15D. The depression 15C and protrusion 15D are female/male respectively, such that when the sidewalls 15A and 15B are closed the male protrusion 15D engages with the female depression 15C to close and secure sidewalls 15A and 15B together as seen in FIG. 7E.

The channel 7 opens into a first preferential chamber 16A, which is formed when sidewalls 8A and 8B of the applicator are closed.

A second preferential chamber 16B is formed when the applicator is in the closed position because divider 17 is lower on sidewall 8A than divider 17B is on side wall 8B. Accordingly when side walls 8A and 8B are closed, divider 17 is lower and closest to the base 5 and divider 17B is slightly above it, but enough so that the distance between the two dividers 17 and 17B forms a small chamber. When applicator 2 is closed and the side walls 8A and 8B are engaged, divider 17 will form the top surface of first preferential chamber 16A and second preferential chamber 16B will be found in the space between divider 17 and divider 17B.

The first preferential chamber 16A in cross-section, is depicted in FIG. 7A. Divider 17 separates the first preferential chamber 16A from second preferential chamber 16B and divider 17B separates second preferential chamber 16B from third chamber 18 (all shown in cross-section in FIG. 7A).

Placed on side walls 8A and 8B in a position so that they will abut the top of channel 7 on either side when side walls 8A and 8B are in the closed position, are two sets of ledges 17A and 17AB respectively that, together with the channel 7, form the bottom portion of the first preferential chamber 16A.

Divider 17 does not span the entire width of the applicator 2 interior surface as is seen in FIG. 7A. Rather, divider 17 is slightly shorter in length than the width of the applicator 2 interior surface to permit passages 19 on either side thereof which interconnect the first preferential chamber 16A and the second preferential chamber 16B with the third chamber 18 all of which are formed when the applicator 2 is in the closed position The third chamber 18 has top wall 18A in side wall 8A and top wall 18B in side wall 8B. Top walls 18A and 18B abut when side walls 8A and 8B are engaged, and contain outlets 20.

Figure 3:
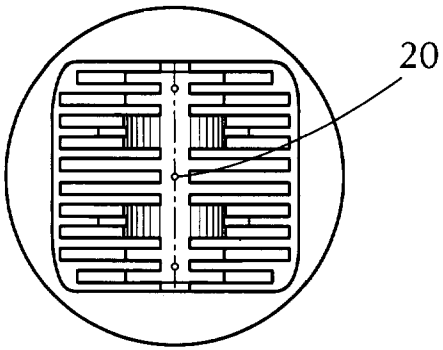
FIG. 3: is a top plan view of the cosmetic container of FIG. 1.

In particular top wall 18A has three half outlets 20A and top wall 18B has three half outlets 20B such that when side walls 8A and 8B are engaged to close applicator 2 half outlets 20A and 20B join to form single outlets as is seen in FIG. 3 which is a top plan view of the applicator 2 in the closed position.

The outlets 20 are surrounded by tines 21 which extend beyond outlets 20. The tines extend beyond the outlets 20 such that the outlets 20 are found in the bore, or at the base of the tines 21 in top walls 18A and 18B.

In the preferred embodiment of the invention the tines 21 are in three groups of three, for a total of nine, and there are three outlets 20, where each outlet is found in a position parallel to the second tine 22 in the three groups of three tines formed when the applicator 2 is in the closed position.

Tines 21 extend beyond outlets to form comb like projections to facilitate combing of the highlighting composition through the hair strands.

Figure 7D:
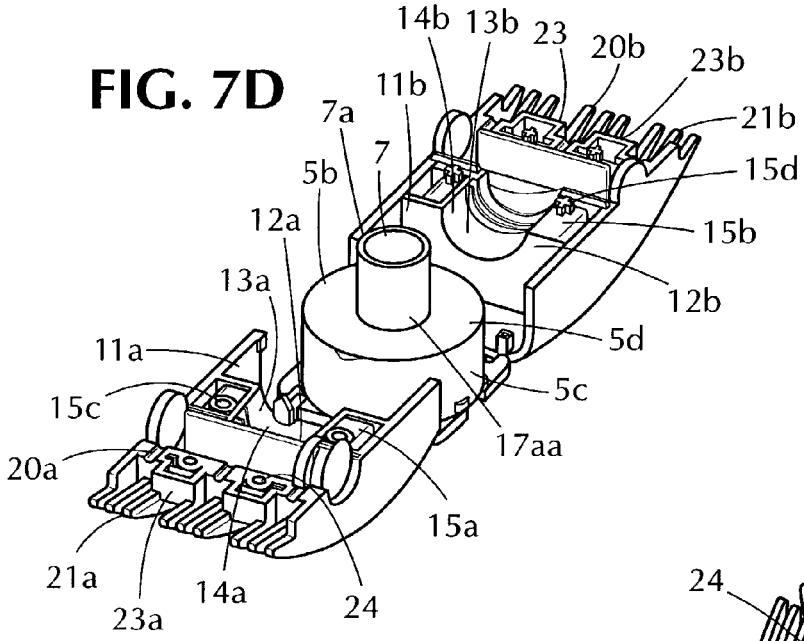
FIG. 7D: is a top perspective view of the applicator in the open position.
Figure 7E:
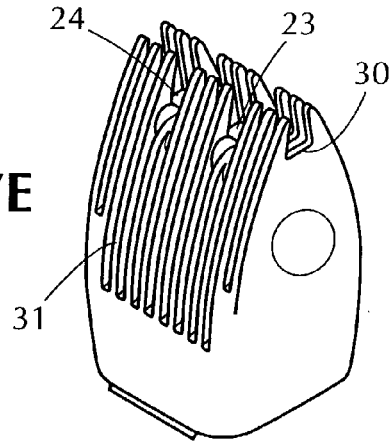
FIG. 7E: is a perspective view of the applicator in the closed position.
Figure 7F:
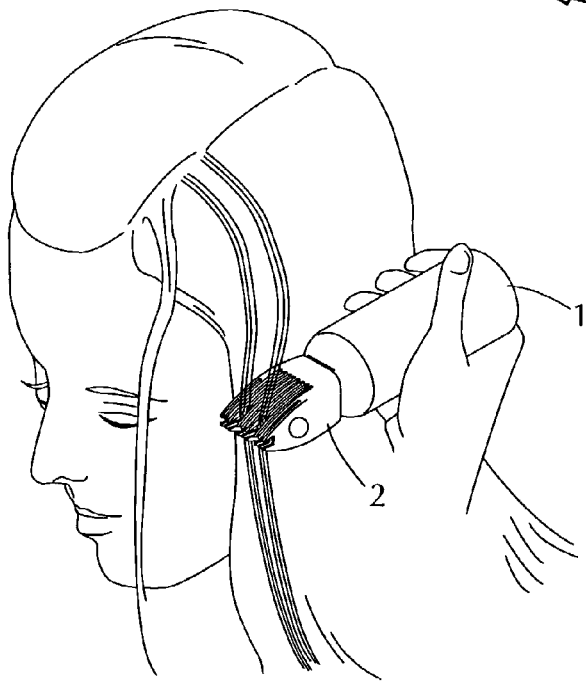
FIG. 7F: depicts use of the cosmetic applicator and storage container to apply cosmetic, particularly hair bleach, to select strands of hair.

When the applicator 2 is in the open position as depicted in FIG. 7D, each side wall 8A and 8B exhibits tines 21A and 21B. When the applicator 2 is in the closed position, 21A and 21B form separate rows of tines 21 which are parallel to each other extending beyond the top surface formed when top walls 18A and 18B are engaged.

Separating tines 21A and 21B in two places are half platforms 23A and 23B. In particular, half platforms 23A and 23B are placed in the middle between tines 21A and 21B such that when the applicator 2 is closed, the half platforms 23A and 23B join to form a full platform 23 which separates outlets 20.

When the applicator 2 is in the closed position the pattern of tines and outlets is three tines 21, platform 23, three tines 21, platform 23, three tines 21, as depicted in FIGS. 7D and 7E.

In the top walls 18A and 18B, it is desirable to incorporate male/female engagements to facilitate closure of side walls 8A and 8B of applicator 2 such that the two side walls 8A and 8B are secured at the upper portion of the applicator 2 as well.

Immediately below one or both half platforms 23A on the inner surface 23B of top wall 18A a female engagement 24 may be found. Similarly on the inner surface 25 of top wall 18B one or more male engagements 26 may be placed. When side walls 8A and 8B are closed, female engagement 24 mates with male engagement 26 to further secure top walls 18A and 18B together.

Preferably, side walls 8A and 8B have circular portions 27 and 28 which, when side walls 8A and 8B are closed, friction fit together to further secure the two side walls together. The circular portions may also serve as grips to facilitate opening and closing of the applicator 2.

The exterior surface of applicator 2 is best seen in FIG. 7C which is a bottom plan view of the applicator in the open position (the opposite of FIG. 7A) and FIG. 7E which is a perspective view of the applicator in the closed position. The exterior surface shows the tines 21 which have free ends 29 that extend beyond the base portion 30 that is formed when top walls 18A and 18B are secured. The cosmetic material 5E that is dispensed through the applicator 2 flows through outlets 20 onto the base portion 30 and is distributed on the hair by tines 21A and 21B. The flow of the cosmetic material 5E onto base portion enables better distribution of the cosmetic onto all of the tines. In particular, the central placement of outlets 20 on base portion 30 also contributes to even distribution of the cosmetic onto the hair surface.

The tines, 21A and 21B extend downwardly from the free ends 29 and when they meet base portion, the tines are affixed to the outer surface of applicator 2 to form channels 31 on the external surface thereof. Channels 31 have a depth ranging from about 0.001 to 0.25 inch. Such channels 31 further facilitate the comb through process enabling the cosmetic material 5E dispensed from the applicator 2 to flow out of outlets 20 downwardly from base portion 30 and into channels 31 where it is distributed therein. When the user strokes applicator 2 through the hair the cosmetic material 5E in channels 31 deposits in streaks on the hair.

This particular arrangement of the outlets, chambers, and channels, as found within the applicator facilitates application of the hair color composition in exactly the right distribution and amount. The liquid product flows from the receptacle 1 through channel 7 into first preferential chamber 16A, through second preferential chamber 16B, and into third chamber 18, and from third chamber 18 through outlets 20. When the tines 21 of the applicator are stroked through the hair as depicted in FIG. 7F, the correct amount of hair color or bleach product deposits on the hair as the applicator is combed through the hair strands.

Most amazingly, this type of construction reduces the skill required of the consumer. In particular, no matter how unskilled the consumer is in applying the colorant composition it always provides an ultimate end result that is pleasing. This is due to the positioning of the tines, and construction of the preferential chambers and outlets, which regulates the flow and distribution of product to exactly the right level.

While preferably the cosmetic container is used to apply highlights to the hair, it may be used to apply other types of hair care products such as conditioner, hair color, and the like.

In the most preferred embodiment of the invention, the cosmetic container is used to apply highlights in a highlighting procedure. More specifically a bleach composition in the form of particulate persulfate salts is stored in the receptacle. When the consumer desires to bleach the hair, the highlighting composition is prepared by adding an aqueous peroxide based oxidizing agent, which activates the persulfate salts, to the contents of the receptacle and mixing well. The applicator is affixed to the receptacle and the container is used to apply the highlighting composition to the hair by stroking the applicator tines through the hair in the same manner as a comb. The container is held so that the applicator is downward, which facilitates flow of the highlighting composition through the applicator and onto the hair strands. After the hair has been treated with the highlighting composition for the appropriate period of time, it is removed by rinsing with water.

In the most preferred embodiment of the invention, after the hair is rinsed with water to remove the highlighting composition, residual oxidizing agent remains on the hair strands that were treated with the highlighting composition.

Then the hair is treated with a second colorant composition which is free of oxidizing agent but contains at least one dye operable to color hair in the presence of the residual oxidizing agent on the hair fibers. This second colorant composition is preferably in the form of an aqueous based shampoo having water, a cleansing surfactant (which may be anionic, nonionic, zwitterionic, or amphoteric), and the dye. The second colorant composition is applied to the hair for about 1 to 20 minutes and rinsed off with water. The dye present in the second colorant composition will be activated by the residual oxidizing agent left on the hair strands. This in turn will cause the hair strands treated with the oxidizing agent to become colored.

The hair may then be treated with an appropriate coloring or conditioning agent. Suitable bleach compositions and oxidizing agent compositions suitable for use in the claimed product are disclosed in U.S. provisional patent application Ser. No. 60/397,346, filed Jul. 19, 2002, which is hereby incorporated by reference in its entirety.

While the invention has been described in connection with the preferred embodiment, it is not intended to limit the scope of the invention to the particular form set forth but, on the contrary, it is intended to cover such alternatives, modifications, and equivalents as may be included within the spirit and scope of the invention as defined by the appended claims.

We claim:

1. A packaged hair treatment composition comprising:

(a) a receptacle having at least one opening and containing the hair treatment composition, (b) an applicator for applying the hair treatment composition in the receptacle to the hair, which is attachable to the at least one opening of the receptacle, said applicator having a base and two engaging sidewalls where the sidewalls are attached to the base by living hinges, said applicator containing an internal channel feeding into at least one internal chamber having at least one external outlet surrounded by tines.

2. The package of claim 1 wherein the hair treatment composition is a hair bleach.

3. The package of claim 1 wherein the wherein sidewalls have an internal surface which forms the interior portion of the applicator and an exterior surface which forms the exterior of the applicator.

4. The package of claim 3 wherein the at least one internal chamber comprises a plurality of sequentially interconnected internal chambers which are found on the internal surface of the side walls.

5. The package of claim 4 wherein the plurality of sequentially interconnected internal chambers comprises at least two internal chambers.

6. The package of claim 4 wherein the plurality of sequentially interconnected internal chambers comprises at least three internal chambers.

7. A packaged hair treatment composition comprising:

(a) a receptacle having at least one opening and containing the hair treatment composition, (b) an applicator for applying the hair treatment composition in the receptacle to the hair having a base in the form of a cap for the container having a channel there through and two engaging sidewalls that form first, second, and third chambers when sidewalls are engaged, wherein when said base is attachable to the at least one opening of the receptacle said channel feeds into the first preferential chamber, which feeds into the second preferential chamber, which feeds into the third chamber, which feeds into external outlets surrounded by tines.

8. The package of claim 7 wherein the hair treatment composition is hair bleach.

9. The package of claim 7 wherein the hair treatment composition is hair color.

10. The package of claim 8 wherein the hair bleach composition comprises persulfate salts mixed with an aqueous oxidizing agent.

11. The package of claim 7 wherein the receptacle is a plastic bottle.

12. The package of claim 7 wherein the two engaging sidewalls are engaged by living hinges.

13. The package of claim 7 wherein the engaging sidewalls have internal surfaces and wherein the internal surfaces of the sidewalls contains a carved out portion which houses the base when the two engaging sidewalls are engaged.

14. The package of claim 13 wherein the carved out portion on each side wall is formed by circumferential walls, each of said walls having a shoulder and a collar.

15. The package of claim 14 wherein each of the collars is in a semi-circular shape.

16. The package of claim 15 wherein the base contains a channel and when sidewalls are engaged both collars together form a complete collar that encircles the channel of the base.

17. The package of claim 16 wherein the side walls of one collar contain female engagements and the side walls of the other collar contain male engagements and when the side walls are in the enclosed position the engagements mate.

* * * * *